United States Patent [19]

Novis

[11] Patent Number: 4,483,577

[45] Date of Patent: Nov. 20, 1984

[54] ELECTRICAL BRIDGING CONNECTOR AND METHOD OF USE

[76] Inventor: Joseph R. Novis, 3798 Kensington Dr., Marietta, Ga. 30066

[21] Appl. No.: 337,578

[22] Filed: Jan. 7, 1982

[51] Int. Cl.[3] ..... H01R 13/44; H01R 43/00

[52] U.S. Cl. ..... 339/38; 29/857; 339/176 M

[58] Field of Search ..... 29/854, 855, 868; 339/154 R, 154 A, 65, 66 R, 66 M, 66 T, 206 P, 206 R, 217 S, 208, 156 R, 205, 209, 91 R, 17 F, 159 R, 159 M, 38, 176 MP

[56] References Cited

U.S. PATENT DOCUMENTS

| | | | |
|---|---|---|---|
| 3,035,244 | 5/1962 | Aveni | 339/156 |
| 3,359,533 | 12/1967 | Barry | 339/217 |
| 3,364,458 | 1/1968 | Black, Jr. et al. | 339/184 |
| 3,383,648 | 5/1968 | Tems | 339/258 |
| 3,529,279 | 9/1970 | Logue et al. | 339/176 |
| 3,663,922 | 5/1972 | Foust, Jr. et al. | 339/176 MF X |
| 3,740,697 | 6/1973 | Van Son | 339/103 M |
| 3,745,515 | 7/1973 | Michaels | 339/156 R |
| 3,747,050 | 7/1973 | Hecht | 339/156 A |
| 3,850,499 | 11/1974 | Bauerle et al. | 339/156 R |
| 3,854,788 | 12/1974 | Goodman | 339/176 M |
| 3,894,784 | 6/1975 | Clewes | 339/156 R |

FOREIGN PATENT DOCUMENTS

| | | | |
|---|---|---|---|
| 1034236 | 6/1966 | United Kingdom | 339/176 MP |

OTHER PUBLICATIONS

Document Captioned "Price Sheet: OEM-282" (front only of one page).

Document Entitled "Bridgeklip-2 Bridging System" (front and reverse of one page).

*Primary Examiner*—Howard N. Goldberg
*Assistant Examiner*—Carl J. Arbes
*Attorney, Agent, or Firm*—Kilpatrick & Cody

[57] ABSTRACT

A conducting bridging connector to permit stacking electronic jacks having wire-wrap posts disposed in pairs forming a double row and corresponding pin receiving receptacles. The connector has a nonconductive body with a blade and tooth comb structure to separate the wire-wrap posts and spring contacts to make electrical contact with the posts on one jack and corresponding pins to be received by a second jack. A nonconducting bridging insulator permits temporary stacking of jacks while electrical connection is made to a new jack, and a wire-wrap post straightener may be utilized to straighten bent wire-wrap posts before mounting the insulator or connector. A method of utilizing the bridging insulator, bridging connector and post straightener is also disclosed which facilitates retermination of cable connecting to electronic equipment such as remreed line-link or trunk-link network electronic switching system telephone equipment.

15 Claims, 8 Drawing Figures

ELECTRICAL BRIDGING CONNECTOR AND METHOD OF USE

BACKGROUND OF THE INVENTION

This invention relates to an electrical bridging connector to permit convenient and reliable electrical connection of a jack to wire-wrap posts, which posts are typically on a like jack previously wired and in use, and a nonconducting bridging insulator and a wire-wrap post straightner to facilitate such electrical connection as well as a method of using these structures.

This invention is particularly well adapted for utilization with Western Electric 951A connectors or jacks which connect to Western Electric remreed line-link or trunk-link network No. 1A and No. 1 electronic switching system telephone equipment.

Western Electric 951A jacks are used to connect multiple conductor cables to the above-described equipment. One such jack can connect up to thirty-two conductors. For a variety of reasons, particularly including the need to expand or alter service, telephone company users of such equipment frequently need to connect additional or substitute cables to the switching equipment after the original 951A jack is wired and installed. Such recabling is typically done by wire wrapping the conductors of the new cables on the wire-wrap posts of the existing 951A jack and later cutting the old, first connected cables out of the system, thereby disconnecting them from the 951A jack. Alternatively, in the prior art practice, splices are made directly onto existing cable conductors, which is referred to as a "half-tap" or "Y-splice" of the cable. Both methods of connecting new cables to the existing equipment make it difficult to identify and repair electrical problems experienced in the system, are difficult to accomplish, frequently result in loss of service of all or a portion of the system for undesirably long periods, and require large amounts of labor, particularly when virtually simultaneous disconnection of various cables must occur during service interruptions to permit switching from an old cable system to a newly installed one.

SUMMARY OF THE INVENTION

Recabling may be accomplished more easily and with fewer problems by utilization of the present invention. Such recabling is generally accomplished by mounting the nonconducting bridging insulator of the present invention on the existing 951A jack installed in the remreed network at the point where connection of the new cable is desired, and a new 951A jack is mounted on the back of the bridging insulator. Then, without interrupting existing service or risking introduction of a short circuit resulting from contact between adjacent wire-wrap posts of the existing 951A jack, the new cable can be fanned and formed accurately and connected to the new 951A jack because the new jack is positioned in or very close to the location in which it will ultimately be utilized. Then, the bridging insulator may be removed and the bridging connector of the present invention may be plugged into the back of the new 951A jack to permit electrical verification of correct connection of the new cable to the new jack by testing through the bridging connector. Thereafter, at a convenient time, typically when there is minimum telephone traffic on the circuits, the new jack may be electrically connected to the remreed network by removing the old 951A jack from the network, stacking it on the back of the bridging connector, and plugging the new 951A jack into the network.

At a subsequent time, the old jack and the bridging connector may be removed without interrupting service, and the old cable may thereafter be removed or "mined" and thereby recovered whenever convenient.

Alternately, the old 951A jack can be left connected to the network and the new jack may be electrically connected to the old one by means of an intermediate bridging connector of the present invention, thus electrically stacking the new jack on top of the old one.

A related structure of the present invention is a wire-wrap post straightener which may be utilized together with the bridging insulator, bridging connector and method of the present invention to straighten and separate wire-wrap posts where that is required.

It is therefore an object of the present invention to provide a nonconducting bridging insulator or connector for temporarily mounting jacks in or adjacent to the physical location in which they will be ultimately utilized to facilitate attachment of cable leads to such jacks.

It is another object of the present invention to provide a method of connecting new telephone cables to existing telephone equipment which minimizes service interruption, reduces the likelihood that wiring errors will occur and facilitates "mining" or removal of old cable after the new cable is placed in service.

It is yet another object of the present invention to provide a conducting bridging connector to permit "stacking" of wire-wrap jacks to permit parallel electrical connection of such jacks.

It is a further object of the present invention to provide a convenient wire-wrap post straightener to straighten and separate rows of wire-wrap posts to facilitate connection to such posts by conventional wire-wrap connection or utilization of the bridging insulator and bridging connector of the present invention.

DETAILED DESCRIPTION OF THE DRAWINGS

In the figures, jacks 12 and 14 are electrical jacks having pairs of wire-wrap posts 16 forming a double row of posts for connection of cable leads 17, which are typically wrapped on the posts 16 close to the jack 12 body, thus leaving the ends of posts 16 bare. The jacks 12 and 14 illustrated are Western Electric model 951A jacks normally utilized with Western Electric remreed line-link or trunk-link network No. 1A or No. 1 electronic switching system telephone equipment.

Figures 1, 2, 3:
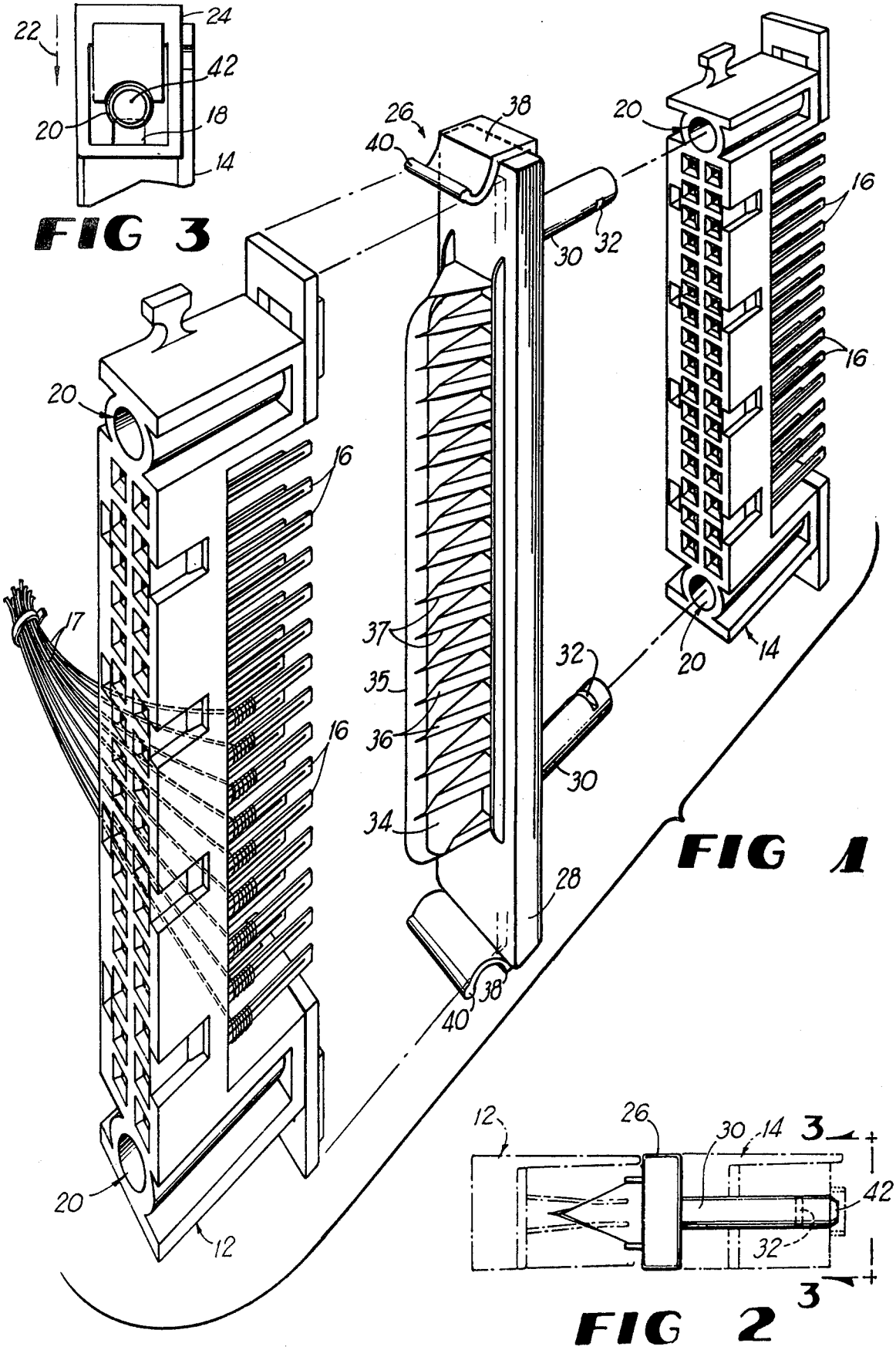
FIG. 1 is an exploded perspective view of the nonconducting bridging insulator of the present invention shown disposed between two Western Electric Model 951A jacks.
FIG. 2 is an end view of the bridging insulator of FIG. 1 connecting two 951A jacks shown in broken lines.
FIG. 3 is a fragmentary view of one end of a 951A jack and one bridging insulator stud showing the mounting connection between the jack and the bridging insulator.

The 951A jacks 12 and 14 have a tab or tangent 18 visible in FIG. 3 which extends partially into a cylindrical bore 20 at either end of the jack 12 or 14. Tangent 18 is biased to extend into bore 20 but may be pivoted out of the bore 20 by pressure exerted in the direction indicated by arrow 22 in FIG. 3 on ear 24 or on the tangent 18 itself to permit insertion of jack 12 over metal studs (not shown) on remreed telephone switching equipment by receiving such studs in bores 20. Tangent 18 then engages an annular depression in such studs to lock jack 12 in place on the remreed switching equipment.

The nonconducting bridging insulator of the present invention is indicated generally by numeral 26 in FIG. 1. Bridging insulator 26, also shown in a front elevational view in FIG. 4, comprises generally a body 28, studs 30 having slots 32, a blade 34, teeth 36, and an attaching means such as clips 38. Body 28 is a rectangular plate approximate as long and wide as jack 12 and of a convenient thickness, such as approximately three-sixteenths of an inch (5 millimeters). Blade 34 is also a generally rectangular plate mounted normal to body 28 as long as the space between ears 24 on jack 12 when tangents 18 are fully extended into bores 20 of jack 12, of width just less than the length of posts 16 and having a sharp leading edge 35. Each tooth 36 is a triangular plate abutting and normal to both the blade 34 and body 28 and having a sharp exposed edge 37. Teeth 36 are approximately two-thirds as tall as blade 34 is wide and are located on both sides of blade 34 with spaces between teeth 36 slightly larger than the width of posts 16 on jack 12 so that such posts 16 will be securely captured between adjacent teeth 36. Teeth 36 are located to be between adjacent posts 16 when bridging insulator 26 is mounted on jack 12.

Slots 32 in studs 30 are formed by removing or omitting segments of studs 30 corresponding to the location of tangent 18 in jack 14 when jack 14 is mounted on insulator 26, and studs 30 have chamfered ends 42 shown on FIG. 2. Clip 38 may be any appropriate spring structure positioned on each end of insulator 24 having arms 40 to removably engage and capture ears 24 or other portions of jack 12 and thereby firmly mount bridging insulator 26 on jack 12. Accidental removal of jack 12 from the remreed equipment to which it is attached during removal of insulator 26 cannot occur because the ends of blade 34 contact both ears 24, thereby limiting movement of ears 24 and thus holding tangents 18 in place on the studs on which jack 12 mounts.

Bridging insulator 26 may be molded or machined of any suitable nonconducting material such as polycarbonate plastic. Clip 38 may be molded of polycarbonate or other suitable plastic or manufactured of any other suitably springy material such as metal, as will be readily appreciated by one skilled in the art.

Bridging insulator 26 is utilized inserting blade 34 between the two rows of wire-wrap posts 16 on the existing jack 12, pressing blade 34 into the space between wire-wrap posts 16 until the arms 40 of clips 38 engage and removably capture ears 24 of jack 12. Clips 38 hold bridging insulator 26 in place with respect to jack 12, and blade 34 prevents electrical contact between pairs of wirewrap posts 16 in the two rows of posts 16 while teeth 36 prevent electrical contact between adjacent wire-wrap posts in such rows.

A new jack 14 is then mounted on bridging insulator 26 by receiving studs 30 of bridging insulator 26 in cylindrical bores 20 of jack 14 and forcing the studs 30 into bores 20 until tangent 18 of jack 14 is biased out of bore 20 by the advancing chamfered end 42 of stud 30 (visible in FIG. 2). As studs 30 continue to advance into bore 20, tangents 18 seat in slots 32 of studs 30, thereby capturing studs 30 and holding jack 14 in place on bridging insulator 26 until tangents 18 of jack 14 are disengaged by pressure exerted in the direction indicated by arrow 22 in FIG. 3 on ear 24 of jack 14 as jack 14 is removed.

As will be readily appreciated by one skilled in the art, temporarily mounting new jack 14 by means of nonconducting bridging insulator 26 adjacent to existing jack 12, to which jack 14 will eventually be connected or which jack 14 will replace, permits the leads of the new cable (not shown) to be fanned and formed accurately and to be accurately located and cut to length. It will similarly be appreciated that the comb structure of blade 34 and teeth 36 will simultaneously diminish the likelihood that a short circuit resulting from contact between wire-wrap posts 16 of old jack 12 will be inadvertently created while wiring of jack 14 is being accomplished.

After the new cable leads have been connected to wire-wrap posts 16 of jack 14, and, if desired, pair verification or other electrical testing has been accomplished, jack 14 may be electrically connected to the electronic equipment with which it is used by one of at least three alternative procedures. If continued electrical connection of jack 12 is no longer desired, jack 14 may be removed from bridging insulator 26, jack 12 removed from the equipment to which it is connected, and jack 14 connected directly to such equipment. If continued temporary or permanent electrical connection of jack 12 is desired, the above-described procedure may be followed by mounting bridging connector 44, shown in FIGS. 5 and 6 on the wire wrap-pins 16 of jack 14 as is described below and mounting jack 14 on the pins 46 of bridging connector 44. Alternatively, where interruption of service to the cable connected to the existing jack 12 must be avoided or other reasons dictate, demounting of new jack 14 from bridging insulator 26 and removal of bridging insulator 26 from existing jack 12 may be followed by mounting new jack 14 on the pins 46 and studs 48 of bridging connector 44 and then mounting bridging connector 44 on the wire-wrap posts 16 of existing jack 12 as is indicated by the exploded view of such connection in FIG. 5 and the sectional view of FIG. 6.

Figures 4, 7, 8:
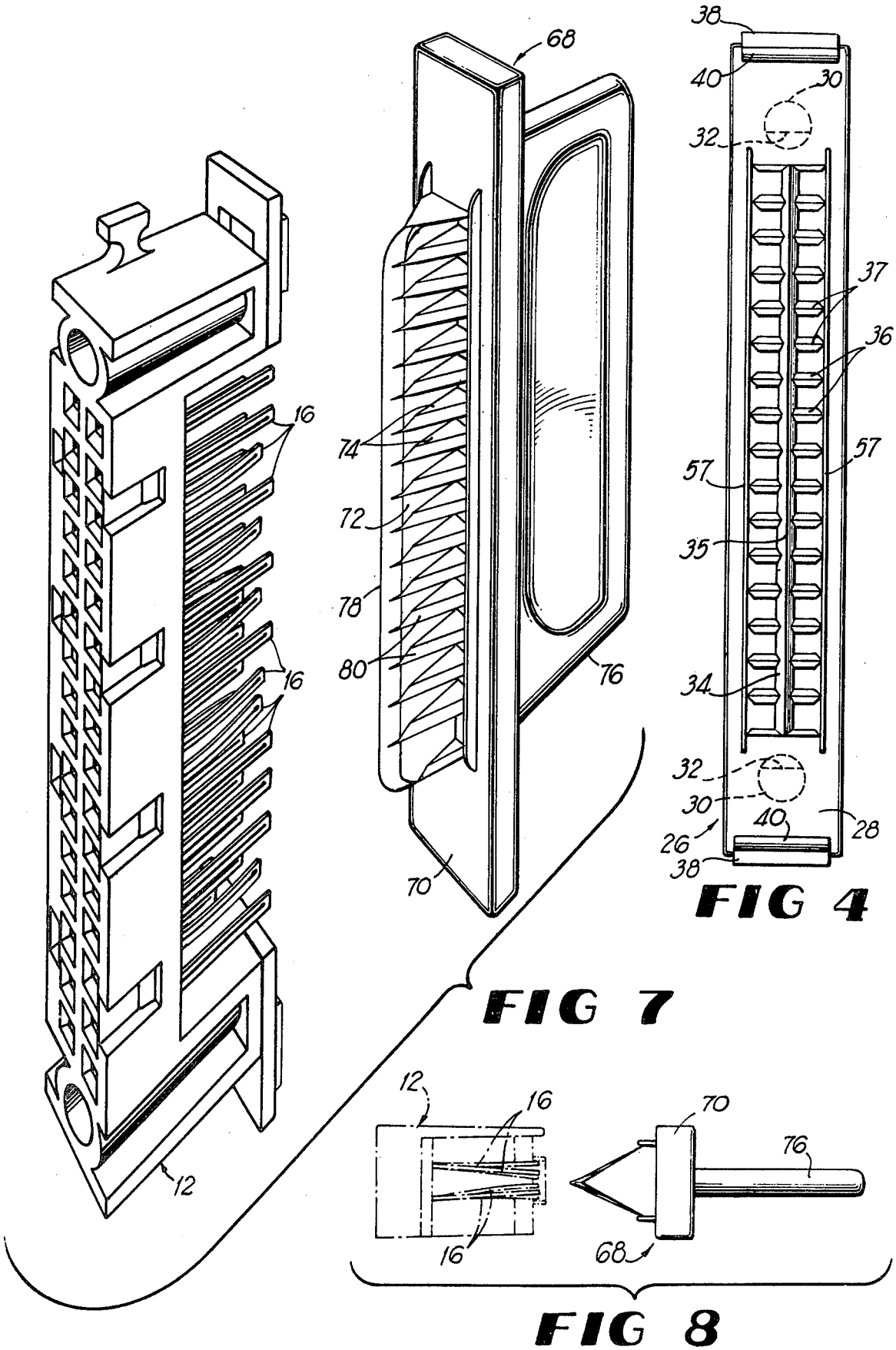
FIG. 4 is a front elevational view of the nonconducting bridging insulator of FIG. 1 with its studs shown in broken lines.
FIG. 7 is an exploded perspective view of the wire-wrap post straightener of the present invention and a 951A jack having bent wire-wrap posts.
FIG. 8 is an end view of the wire-wrap post straightener illustrated in FIG. 7 shown positioned for insertion in a 951A jack having bent posts.
Figures 5, 6:
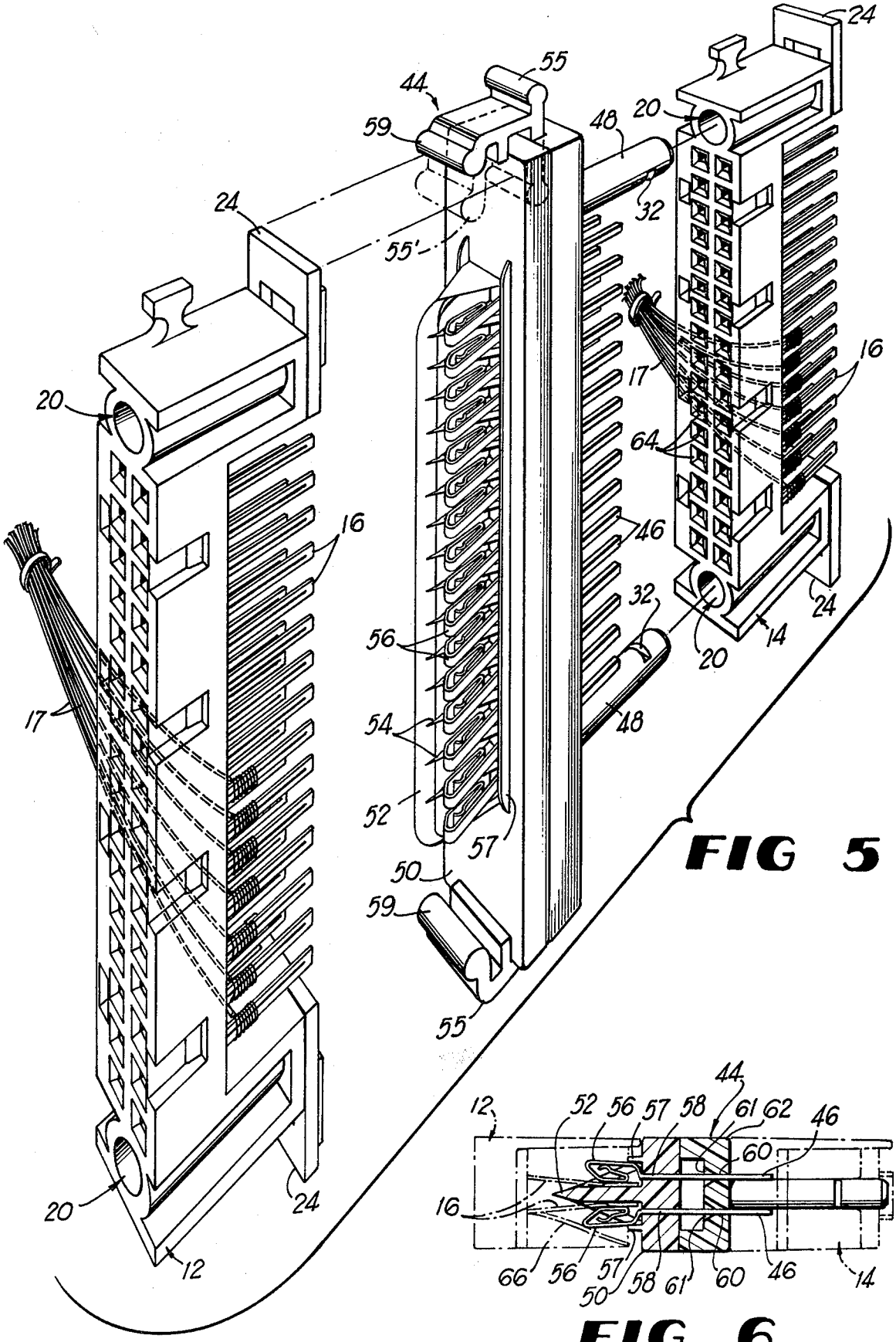
FIG. 5 is an exploded perspective view of the conducting bridging connector of the present invention shown disposed between two Western Electric Model 951A jacks.
FIG. 6 is an end view in section of the bridging connector of FIG. 5 connecting two 951A jacks shown in broken lines.

Bridging connector 44 shown in FIGS. 5 and 6 comprises generally a body 50 similar in structure to the body 28 of nonconducting bridging insulator 26, having studs 48 with slots 32, a blade 52, teeth 54 and clips 55. The structure of blade 52 and teeth 54 is substantially similar to the structure of blade 34 and teeth 36 of bridging insulator 26; accordingly, the geometry of blade 52 and teeth 54 of connector 44 will be further appreciated by reference to the front elevational view of bridging insulator 26 appearing in FIG. 4 and the description above.

Bridging connector 44 also includes contacts 56 which, in the preferred embodiment, are bifurcated bellow spring contacts of phosphor bronze with gold plating over nickel. A rib 57 molded into or affixed to body 50 is located adjacent to each row of contacts 56. Rib 57 bears against the base of contacts 56 opposite to blade 52 to support contacts 56 and oppose the tendency for wire-wrap posts 16 to force contacts 56 away from blade 52 and thereby break contacts 56 off of pins 46 to which they connect. The relationship between rib 57 and contacts 56 is further illustrated in FIG. 6.

Each contact 56 is disposed such that it bears against the side of blade 52, and a contact 56 is located on either side of each tooth 54 and is positioned so as to capture the corresponding wire-wrap post 16 between the contact 56 and blade 52 when connector 44 is mounted on wire-wrap posts 16 of a jack 12 or 14. The desired electrical contact almost always occurs, however, even if a particular wire-wrap post 16 is not captured between the contact 56 and blade 52 because even bent posts 16 typically contact the end of contact 56 or the portion of contact 56 away from blade 52 when connector 44 is mounted on wire-wrap posts. This will be appreciated by reference to FIG. 6, which illustrates electrical contact between a bent wire-wrap post 66 and the end of a contact 56. As will be understood by reference to the discussion of nonconducting bridging insulator 26 above, blade 52 and teeth 54 of connector 44 prevent electrical contact between posts 16 of jack 12 and serve to guide each post 16 into contact with the corresponding contact 56 on connector 44 when the connector 44 is mounted on a double row of wire-wrap posts 16 by inserting blade 52 between the rows and forcing the blade 52 into the space between posts 16 until connector 44 body 50 bears against contact surfaces 40 on jack 12 or 14 or until the ends of the wire-wrap posts 16 contact body 50.

Connector 44 is firmly mounted on jack 12 by utilization of any convenient jack-capturing structure such as clips 55 which slide in and out of the body 50 of connector 44 between a "disengaged" position shown in the solid line illustration at the top of FIG. 5 and an "engaged" position indicated by the broken-line illustration 55' of the same clip 55 in FIG. 5. As can be seen in FIG. 5, the bead 59 of clip 55 captures ear 24 of jack 12 when jack 12 and connector 44 are engaged and clip 55 is forced into its "engaged" position 55'.

Contacts 56 terminate in square wire pins 46 which are inserted through pin holes 58 in body 50 and, as may be seen in FIG. 6, through second pin holes 60 in pin block 62. Pin holes 58 are located in two rows, one on each side of blade 52, with one pin hole 58 on each side of each tooth 54 such that the holes 58 and second pin holes 60 align with pin receiving jack openings or contactors 64 in jack 14. As may be seen in FIG. 6, pin hole 60 may taper to a larger opening 61 on the side of pin block 62 facing body 50 to facilitate assembly of connector 44 by guiding pins 46 into second pin holes 60. Pin block 62 serves accurately to align and support pins 46 so they will be properly located for insertion in the pin receiving contactors or receptacles 64 of jack 14. Jack 14 is guided onto pins 46 by studs 48 which are received in bores 20 of jack 14, and it is held in place by frictional contact between the pin receiving contactors 64 and pins 46 and engagement of slots 32 by tangents 18 of jack 14. Connector 44 body 50, pin block 62 and contact 56/pin 46 units may be assembled by use of any appropriate adhesive such as cyanoacrylate adhesive.

Bridging connector 44 thus provides secure physical mounting for new jack 14 immediately behind existing jack 12 and provides electrical connection between each wire-wrap post 16 of jack 12 and the corresponding wire-wrap post 16 of new jack 14.

Although pins 46 are shown connected directly to contacts 56 in the embodiment of connector 44 illustrated in FIGS. 5 and 6, a manual or electronic switching structure or circuit may also be incorporated in connector 44 to permit interruption of electrical connection between pins 46 and the corresponding contacts 56. A connector 44 incorporating such a switch may be utilized with the switch in the "off" position in place of insulator 26 described above during wiring of jack 14. Electrical connection of jack 14 to jack 12 can then be accomplished simply by actuating the switch to complete electrical contact between pins 46 and contacts 56. Such a switchable connector 44 also permits switching jack 14 in and out of the circuitry without physical removal of jack 14. A mechanical switch may be incorporated in connector 44 by providing an insulated contact carrier journaled to slide within connector 44 and carrying switching contacts to make or break electrical connection between each pin 46 and corresponding contact 56.

An additional structure of the present invention is a wire-wrap post straightener 68, which is shown in FIGS. 7 and 8 together with a connector 12 having bent wire wrapposts 16. Post straightener 68 comprises generally a body 70, blade 72, teeth 74 and handle 76. The structure of body 70, blade 74 and teeth 76 is substantially similar to the body, blade and tooth structures of bridging insulator 26 and connector 44 previously described, and therefore will be fully appreciated by reference to FIG. 4 as well as FIGS. 7 and 8 and the description of bridging insulator 26 and connector 44 above.

Post straightener 68 is utilized by manual manipulation by grasping handle 76 and inserting blade 72 between adjacent rows of wire-wrap posts 16 which need to be straightened or separated prior to connection of cable leads, before mounting a bridging unit 26 or bridging connector 44, or for any other reason. The sharp edge 78 of blade 72 facilitates separation of pairs of posts 16 which are bent such that they touch or nearly touch, and the edges 80 of teeth 74 similarly separate adjacent posts 16. A side to side rocking or partial rotational motion of post straightener 68 during and after insertion of blade 72 between the rows of posts 16 will facilitate utilization of the straightener 68 and straightening and separation of bent posts 16.

Although the present invention is described and illustrated with detailed reference to the preferred embodiment, the invention is not intended to be limited to the details of such embodiment but includes numerous modifications and changes thereto while still falling within the intent and spirit hereof.

I claim:

1. A method of electrically connecting a first cable to contact points on electronic equipment to which a second cable is connected by means of a first jack, which comprises the steps of:

(a) connecting the first cable to a second jack having wire-wrap posts,
(b) mounting a conducting bridging connector on the wire-wrap posts of the second jack,
(c) removing the first jack from the electronic equipment,
(d) connecting the second jack to the electronic equipment, and
(e) connecting the first jack to the bridging connector.

2. The method of claim 1 further comprising verifying continuity between the conducting bridging connector and the first cable through the second jack after said step of mounting the conducting bridging connector on the second jack.

3. A method of electrically connecting a first cable connected to a first jack having wire-wrap posts to contact points on electronic equipment to which a second cable is connected by means of a second jack, which comprises the steps of:
(a) mounting a conducting bridging connector on the wire-wrap posts of the first jack,
(b) removing the second jack from the electronic equipment,
(c) connecting the first jack to the electronic equipment, and
(d) connecting the second jack to the bridging connector.

4. The method of claim 3 further comprising verifying continuity between the conducting bridging connector and the first cable through the first jack after said step of mounting the conducting bridging connector on the first jack.

5. A method of electrically connecting a first cable to contact points on electronic equipment to which a second cable is connected by means of a first jack having wire-wrap posts, which comprises:
(a) mounting a nonconducting bridging insulator on the first jack;
(b) mounting a second jack on the nonconducting bridging insulator;
(c) connecting the first cable to the second jack;
(d) removing the second jack from the bridging insulator;
(e) removing the bridging insulator from the first jack;
(f) removing the first jack from the electronic equipment; and
(g) connecting the second jack to the electronic equipment.

6. The method of claim 9 further comprising the steps of:
(h) mounting a conducting bridging connector on the wire-wrap posts of the second jack; and
(i) connecting the first jack to the bridging connector.

7. A method of electrically connecting a first cable to contact points on electronic equipment to which a second cable is connected by means of a first jack having wire-wrap posts, which comprises:
(a) mounting a nonconducting bridging insulator on the first jack;
(b) mounting a second jack on the nonconducting bridging insulator;
(c) connecting the first cable to the second jack;
(d) removing the second jack from the bridging insulator;
(e) removing the bridging insulator from the first jack;
(f) mounting the second jack on a conducting bridging connector; and
(g) mounting the conducting bridging connector on the wire-wrap posts of the first jack.

8. The method of claim 5 or claim 7 further comprising the step of straightening and separating the wire-wrap posts of the first jack prior to step (a) of the method, using a wire wrap post straightener.

9. A bridging connector electrically connecting a plurality of pairs of wire-wrap posts in a first jack in a double row to a like number of pin contactors in a second jack, comprising:
(a) a nonconductive body having a first major surface and a second opposite major surface, a blade extending from the first major surface for separation of each of the pairs of posts located on the first jack and a plurality of teeth extending from the first major surface for separation of adjacent posts in the rows of the first jack,
(b) a plurality of contacts mounted on the first major surface for contact with the posts, and
(c) a plurality of pins electrically connected to the contacts and disposed in the body and extending from the second major surface to be engaged by the contactors in the second jack.

10. A connector according to claim 9, wherein said contacts are bifurcated bellow spring contacts of phosphor bronze with gold plating over nickel and said pins are square in cross-section.

11. A connector according to claim 10, further comprising a pin block attached to the body and having pin holes through which the pins pass.

12. A bridging connector for electrically connecting a plurality of adjacent pairs of wire-wrap posts in a first jack to a second jack having a like number of square pin receiving receptacles and two cylindrical bores, comprising:
(a) a nonconductive body having a first major surface, a second opposite major surface, and a blade extending from the first major surface for insertion between said pairs of posts located on the first jack,
(b) a plurality of bifurcated bellow spring contacts extending from the first major surface to contact the posts, each of the contacts connecting to a square pin projecting from the second major surface of the body, each of said pins being disposed to be received by one of the square pin receiving receptacles in the second jack,
(c) two studs mounted on the second major surface to be received by the bores, and
(d) a means located on the body for attachment of the connector to the first jack.

13. A connector according to claim 12, wherein said attachment means is at least one clip.

14. A bridging insulator for physically mounting a first jack having two cylindrical bores into which tabs are biased on a second jack having a plurality of pairs of wirewrap posts in a double row, comprising a nonconductive body having a first major surface and a second opposite major surface and, a blade extending from the first major surface for insertion between said pairs of posts located on the first jack and a plurality of teeth extending from the first major surface.

15. A bridging insulator according to claim 14, wherein said attachment means is at least one clip.

* * * * *